US010202781B1

(12) United States Patent
Orosco

(10) Patent No.: US 10,202,781 B1
(45) Date of Patent: Feb. 12, 2019

(54) SWIMMING POOL AERATOR

(71) Applicant: Christopher Orosco, Tolleson, AZ (US)

(72) Inventor: Christopher Orosco, Tolleson, AZ (US)

( * ) Notice: Subject to any disclaimer, the term of this patent is extended or adjusted under 35 U.S.C. 154(b) by 296 days.

(21) Appl. No.: 15/132,420

(22) Filed: Apr. 19, 2016

(51) Int. Cl.
*E04H 4/12* (2006.01)
*B01F 3/04* (2006.01)
*B01F 5/06* (2006.01)

(52) U.S. Cl.
CPC ..... *E04H 4/1209* (2013.01); *B01F 3/04049* (2013.01); *B01F 5/0606* (2013.01); *B01F 2215/0052* (2013.01)

(58) Field of Classification Search
CPC ..... E04H 4/1209; B01F 3/04049; B01F 2215/0052; B01F 5/0606
See application file for complete search history.

(56) References Cited

U.S. PATENT DOCUMENTS 1,987,501 A * 1/1935 Andrews
2,888,205 A * 5/1959 Trucco
3,086,715 A * 4/1963 Mineau et al.
3,615,013 A * 10/1971 Reece
4,461,703 A * 7/1984 Vetter
4,591,094 A * 5/1986 Morris
D317,347 S 6/1991 Whitley, II
5,172,432 A * 12/1992 Beland
5,227,056 A * 7/1993 Makino
5,405,294 A * 4/1995 Briggs
5,695,119 A * 12/1997 Lien
6,257,560 B1 * 7/2001 Kim
7,267,325 B2 * 9/2007 Tsai
8,864,986 B1 * 10/2014 Smith
2004/0255373 A1 * 12/2004 Welden
2006/0123537 A1 * 6/2006 Welden
2014/0300010 A1 * 10/2014 Zhou

FOREIGN PATENT DOCUMENTS

WO 1997000123 1/1997

* cited by examiner

*Primary Examiner* — Stephen Hobson
(74) *Attorney, Agent, or Firm* — Kyle A. Fletcher, Esq.

(57) ABSTRACT

The swimming pool aerator is an after-market accessory that is adapted for use with an existing swimming pool. Moreover, the swimming pool aerator utilizes circulated water to dispense via a two-tier water spray profile, which enables heat provided along a top portion of the swimming pool to be more effectively released. The swimming pool aerator features a sprayer body that generates a top tier water spray profile and a bottom tier water spray profile. The top tier water spray profile has smaller water droplets when compared to the bottom tier water spray profile. The swimming pool aerator includes an elbow member that is adapted to connect with a pressurized water source. The elbow member includes a shoulder where a seal is provided. A housing rests atop of the shoulder of the elbow member.

12 Claims, 4 Drawing Sheets

SWIMMING POOL AERATOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of swimming pools, more specifically, an aerator that works with a swimming pool.

SUMMARY OF INVENTION

The swimming pool aerator is an after-market accessory that is adapted for use with an existing swimming pool. Moreover, the swimming pool aerator utilizes circulated water to dispense via a two-tier water spray profile, which enables heat provided along a top portion of the swimming pool to be more effectively released. The swimming pool aerator features a sprayer body that generates a top tier water spray profile and a bottom tier water spray profile. The top tier water spray profile has smaller water droplets when compared to the bottom tier water spray is adapted to connect with a pressurized water source. The elbow member includes a shoulder where a seal is provided. A housing rests atop of the shoulder of the elbow member. The sprayer body extends upwardly from the housing. A fine sprayer is provided adjacent a topmost end of the sprayer body. A course sprayer is positioned underneath the fine sprayer. The fine sprayer is responsible for generating the top tier water spray profile whereas the course sprayer is responsible for generating the bottom tier water sprayer profile.

These together with additional objects, features and advantages of the swimming pool aerator will be readily apparent to those of ordinary skill in the art upon reading the following detailed description of the presently preferred, but nonetheless illustrative, embodiments when taken in conjunction with the accompanying drawings.

In this respect, before explaining the current embodiments of the swimming pool aerator in detail, it is to be understood that the swimming pool aerator is not limited in its applications to the details of construction and arrangements of the components set forth in the following description or illustration. Those skilled in the art will appreciate that the for the design of other structures, methods, and systems for carrying out the several purposes of the swimming pool aerator.

It is therefore important that the claims be regarded as including such equivalent construction insofar as they do not depart from the spirit and scope of the swimming pool aerator. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a plurality of potential embodiments of the disclosure, which are illustrated in FIGS. 1 through 5.

Figure 5:
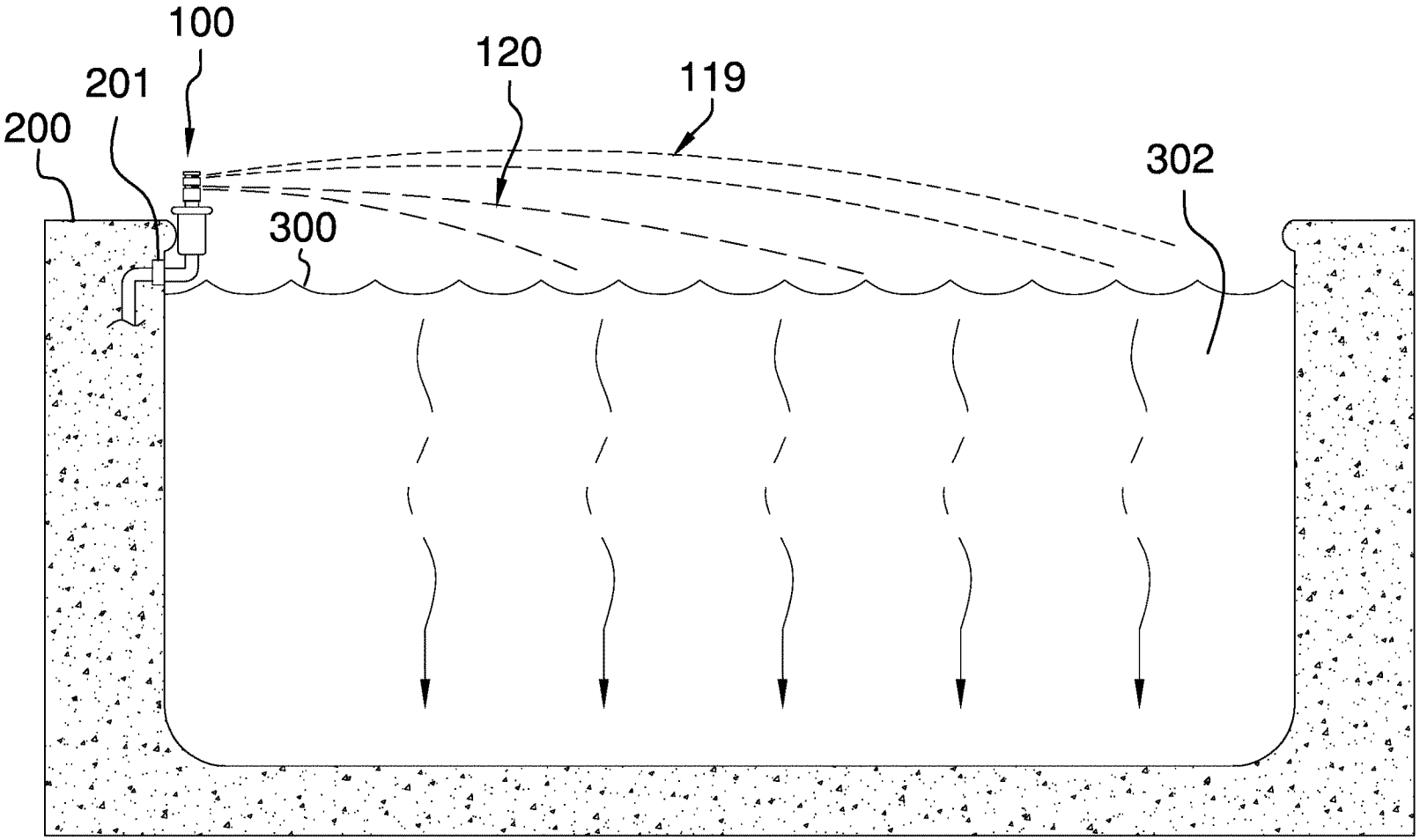
FIG. 5 is a cross-sectional view of an embodiment of the disclosure in use along line 5-5 in FIG. 4.

The swimming pool aerator 100 (hereinafter invention) inlet 102. The inlet 102 of the elbow member 101 includes external threading 103, which is adapted to interface with a re-circulating water jet 201 of a swimming pool 200. Referring to FIG. 5, the elbow member 101 is adapted to be positioned just above a water line 300, and receives re-circulated water 301.

The elbow member 101 is further defined with a shoulder 104 at a second distal end 105. A seal 106 is positioned against the shoulder 104, and works to form a watertight connection between the elbow member 101 and a housing 107. The seal 106 is ideally a gasket, which may be made of rubber. The housing 107 has an inner diameter 108 that is greater than an outer diameter 109 of the shoulder 104.

The housing 107 is further defined with a top opening 110, a groove 111 recessed below the top opening 110, and a cross bracket 112 positioned below the groove 111. The cross bracket 112 has a threaded hole 113 that is centrally located with respect to the housing 107. A sprayer body 114 is included with the invention 100, and is rigidly affixed to the housing 107.

Figure 1:
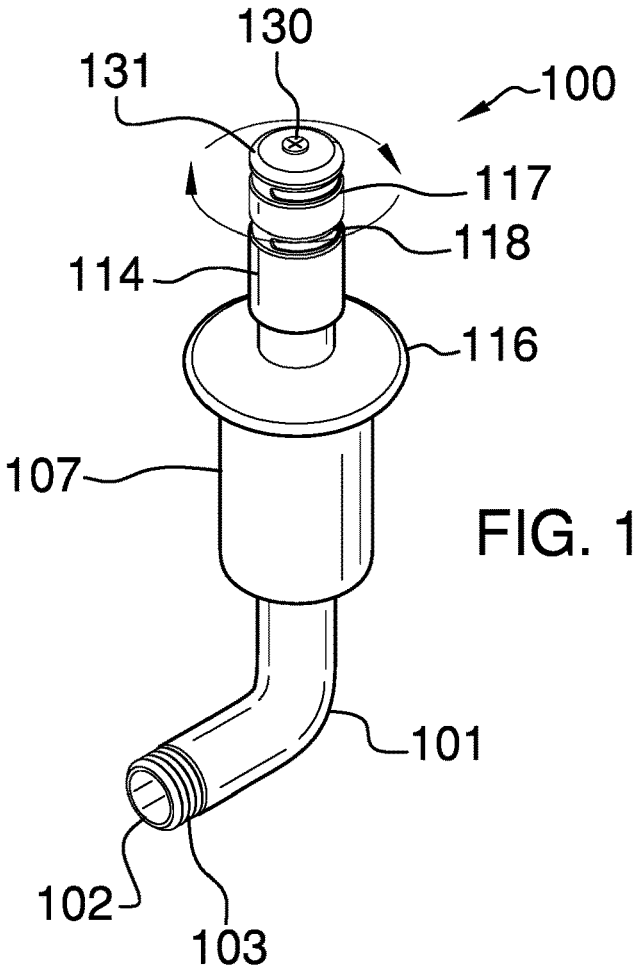
FIG. 1 is a perspective view of an embodiment of the disclosure.
Figure 2:
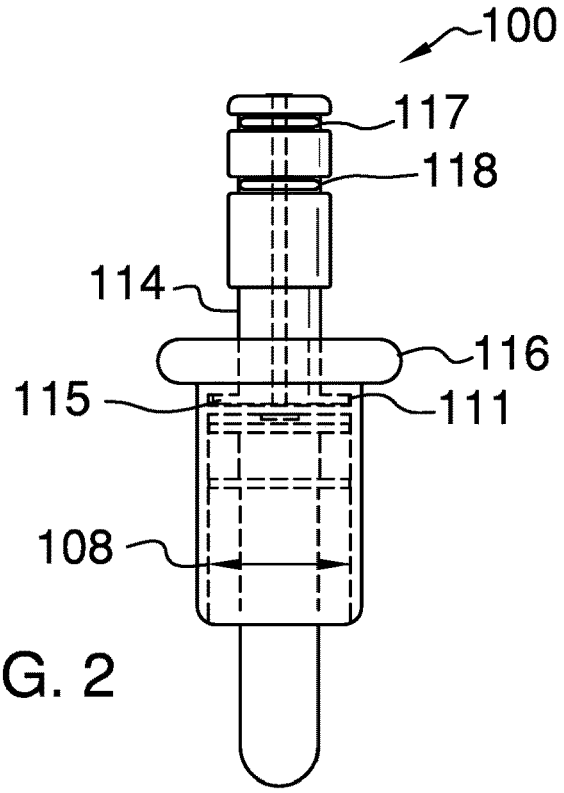
FIG. 2 is a front view of an embodiment of the disclosure.
Figure 3:
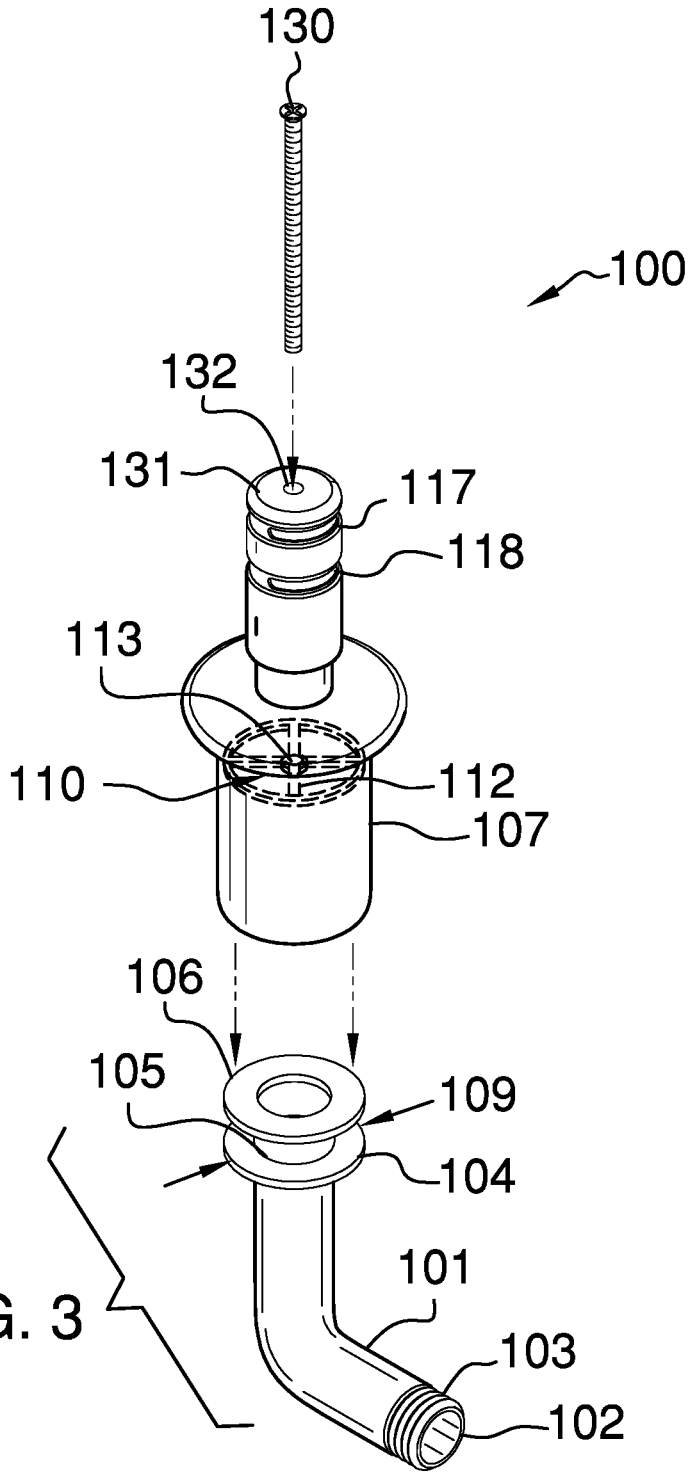
FIG. 3 is an exploded view of an embodiment of the FIG. 4 is a top view of an embodiment of the disclosure in use.
Figure 4:
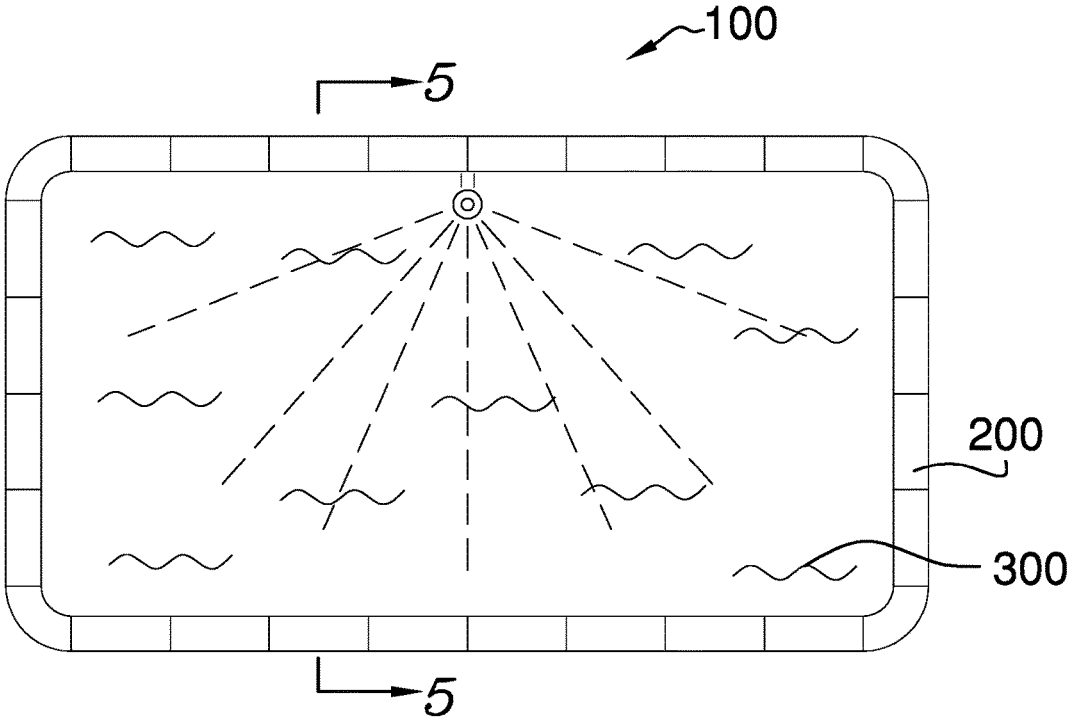

Referring to FIGS. 2-3, the sprayer body 114 includes a second shoulder 115 that is nested within the groove 111 of the housing 107. A halo member 116 is concentrically positioned on the sprayer body 114. Moreover, the halo member 116 is able to be seated atop of the housing 107. The sprayer body 114 extends includes a fine sprayer 117 and a coarse sprayer 118. The fine sprayer 117 is positioned above the coarse sprayer 118.

Referring to FIG. 5, the fine sprayer 117 creates a top tier water spray profile 119; whereas the coarse sprayer 118 creates a bottom tier water spray profile 120. The fine sprayer 117 generates a more atomized water spray when compared to the coarse sprayer 118, which makes the top tier water sprayer profile 119 more atomized than the bottom tier water sprayer profile 120.

The variation in water atomization amongst the top tier water spray profile 119 and the bottom tier water spray profile 120 is intended. The top tier water spray profile 119 generates a greater cooling affect than the bottom tier water spray profile 120. The pool water 302 has a temperature gradient, which means that the water temperature is higher with respect to water depth. Heat is removed from the pool water 302 more effectively at the water line 300. The use of the invention 100 aids in removing heat from the swimming pool 200.

An adjustment screw 130 is provided, and is inserted into the sprayer body 114. The adjustment screw 130 enables the fine sprayer 117 as well as the coarse sprayer 118 to be adjusted in terms of spray area, shape, height, etc. The sprayer body 114 includes a topmost body member 131 that is positioned above the hole 132 provided on the topmost body member 131. The adjustment screw extends into the sprayer body 114, and interfaces with the threaded hole 114 of the cross bracket 113.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A swimming pool aerator comprising:

a sprayer body in adaptive water connection with a re-circulating water jet of a swimming pool;

wherein the sprayer body includes a fine sprayer and a coarse sprayer, which atomize pool water, which is dispensed over said swimming pool in order to evaporatively remove heat from the swimming pool;

wherein an elbow member is further defined with an inlet;

wherein the inlet of the elbow member includes external threading, which is adapted to interface with the re-circulating water jet of the swimming pool;

wherein the elbow member is adapted to be positioned just above a water line, and receives re-circulated water via the re-circulating water jet;

wherein the elbow member is further defined with a shoulder at a first distal end;

wherein a seal is positioned against the shoulder, and works to form a watertight connection between the elbow member and a housing;

wherein the housing has an inner diameter that is greater than an outer diameter of the shoulder;

wherein the housing is further defined with a top opening, a groove recessed below the top opening, and a cross bracket positioned below the groove.

2. The swimming pool aerator according to claim 1 the cross bracket has a threaded hole that is centrally located with respect to the housing.

3. The swimming pool aerator according to claim 2 the sprayer body is included, and is rigidly affixed to the housing.

4. The swimming pool aerator according to claim 3 wherein the sprayer body includes a second shoulder that is nested within the groove of the housing.

5. The swimming pool aerator according to claim 4 a halo member is concentrically positioned on the sprayer body; wherein the halo member is able to be seated atop of the housing; wherein the sprayer body extends vertically from the housing.

6. The swimming pool aerator according to claim 5 wherein the fine sprayer is positioned above the coarse sprayer.

7. The swimming pool aerator according to claim 6 wherein the fine sprayer creates a top tier water spray profile; whereas the coarse sprayer creates a bottom tier water spray profile.

8. The swimming pool aerator according to claim 7 the fine sprayer generates a more atomized water spray when compared to the coarse sprayer;

wherein the top tier water spray profile generates a greater cooling affect than the bottom tier water spray profile.

9. The swimming pool aerator according to claim 8 wherein an adjustment screw is provided, and is inserted into the sprayer body.

10. The swimming pool aerator according to claim 9 wherein the adjustment screw enables the fine sprayer as well as the coarse sprayer to be adjusted in terms of spray area, shape, height.

11. The swimming pool aerator according to claim 10 wherein the sprayer body includes a topmost body member that is positioned above the fine sprayer.

12. The swimming pool aerator according to claim 11 wherein the adjustment screw slides into a screw hole provided on the topmost body member; wherein the adjustment screw interfaces with the threaded hole of the cross bracket in order to secure the sprayer body to the housing.

* * * * *